US005553699A

United States Patent [19]

Hummel et al.

[11] Patent Number: 5,553,699

[45] Date of Patent: Sep. 10, 1996

[54] HIGH CYCLE RATE TRANSFER DEVICE

[75] Inventors: Kenneth W. Hummel, Coon Rapids; David S. Warwick, Mounds View, both of Minn.

[73] Assignee: FMC Corp., Chicago, Ill.

[21] Appl. No.: 317,623

[22] Filed: Oct. 6, 1994

[51] Int. Cl.[6] ..... B65G 25/00

[52] U.S. Cl. ..... 198/737; 198/743; 89/46

[58] Field of Search ..... 198/468.8, 737, 198/743; 414/18; 89/46

[56] References Cited

U.S. PATENT DOCUMENTS 2,526,847 10/1950 Brereton ..... 89/46

3,200,930 8/1965 Blackwood ..... 198/737

4,403,482 9/1983 Fenner ..... 198/743

5,449,061 9/1995 Wald ..... 198/737

*Primary Examiner*—Joseph E. Valenza

[57] ABSTRACT

The high cycle rate transfer device invention disclosed herein enables a continuous conveyance of material in a limited space envelope. Particularly, a roller chain is driven by a center sprocket with outboard rollers on the chain running in a track so that material can be moved in both directions. Pawls on each end of the chain are used to urge the material. Each time the chain is moved, a pawl folding and unfolding mechanism maintains the pawls in a proper position and timed relation to each other.

4 Claims, 2 Drawing Sheets

HIGH CYCLE RATE TRANSFER DEVICE

FIELD OF THE INVENTION

The present invention provides a high cycle rate transfer device for material handling. The device employs cams and connections with a plurality of pawls moving continuously to transfer materials. The invention provides a high cycle and energy efficient material transfer system which is operable in a limited space envelope.

SUMMARY OF THE INVENTION

The high cycle rate transfer device utilizes a fixed length chain with a folding pawl on each end. The chain has outboard rollers which run in a track to provide lateral support and is driven by a sprocket. When the sprocket is driven one pawl unfolds to urge the material while the other pawl is folded in, and temporarily out of the way, to let the material through. The folding and unfolding mechanisms keep the pawls in a proper position and in a timed relation to each other.

Specific advances, features and advantages of the present invention will become apparent upon examination of the following description and drawings dealing with several specific embodiments thereof.

DESCRIPTION OF THE PREFERRED EMBODIMENT

Figure 1:
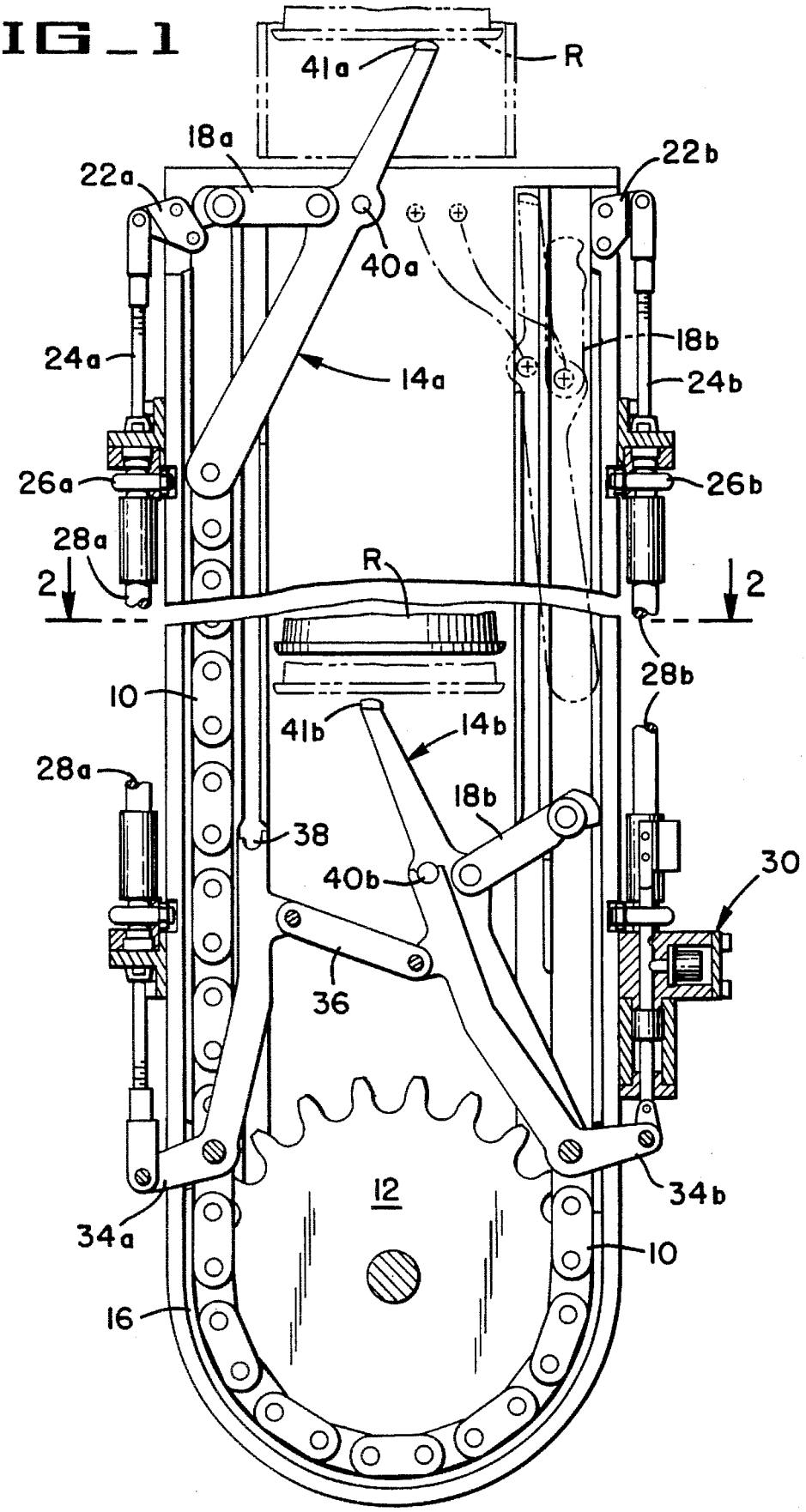
FIG. 1 is a side elevation view of the high cycle rate transfer device showing material (rounds of ammunition) being transferred from a lower position to a final hoisted position. Pawls are shown in extended and unfolded position. The pawl on the right is also shown in its folded and stowed position (phantom lines).

The preferred embodiment of the present invention is shown in FIG. 1. A roller chain 10 is driven by sprocket 12. Pawls 14*a* and 14*b* are attached at the ends of chain 10. Outboard rollers on chain 10 run in track 16. Support links 18*a* and 18*b* at each of pawls 14*a* and 14*b* respectively, provide support and slidably engage track 16. Cam arms 22*a* and 22*b* are in temporal contact with support links 18*a* and 18*b*. Further, support links 18*a* and 18*b* are fitted with a roller on the outboard end that is guided by chain track 16. Cam arms 22*a* and 22*b* are connected to adjustable rod 24*a* and 24*b*. Adjustable rods 24*a* and 24*b* are controlled by upper control cable mount 26*a* and 26*b*. Lower control cable mount 26*a* connects cam arm control cable 28*a* with pawl control arm 34*a*. Similarly, pawl control actuator 30 connects to cam arm control cable 28*b* and pawl control arm 34*b*. Pawl control arms 34*a* and 34*b* are flexibly connected by arm connection link 36. Restrainer section 38 prevents pawl control arm 34*a* from extending beyond a preset limit position. Pawls 14*a* and 14*b* include guide pins 40*a* and 40*b*. Further, pawls 14*a* and 14*b* include soft cushions or non-metallic tips 41*a* and 41*b* as shown. Hoist tube 42 is shown in which rounds are transferred to be supported and pushed by pawls 14*a* and 14*b*.

Figure 2:
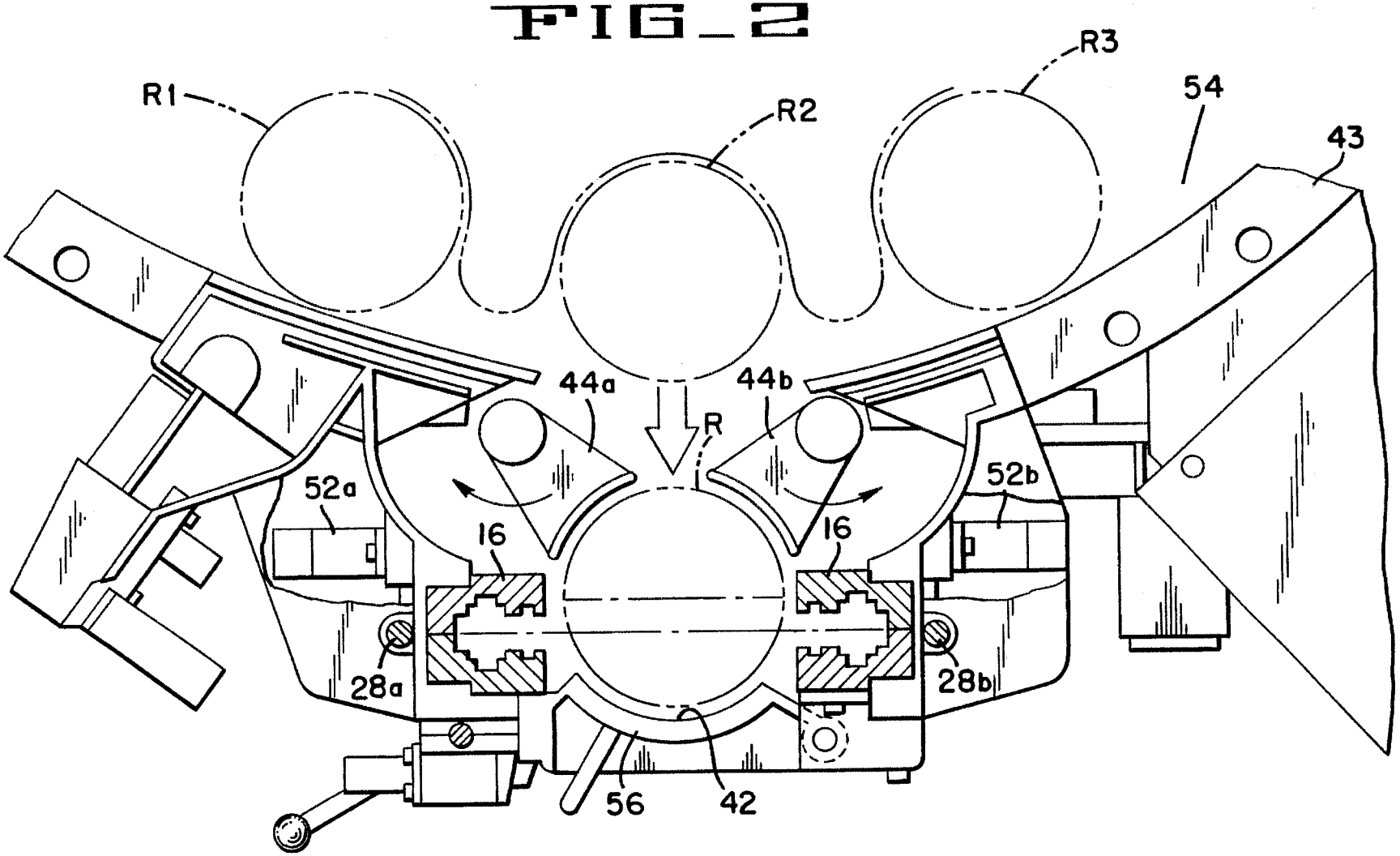
FIG. 2 is a section taken along line 2—2 of FIG. 1, showing a portion of a magazine drum and a plan view of the high cycle rate transfer device. Rounds are shown in the magazine with one round loaded in the upper hoist tube.

Referring now to FIG. 2, rounds $R_1$, $R_2$ and $R_3$ are shown in loader structure 43. Round $R_2$ is transferred into hoist tube 42 where it is eccentrically positioned relative to pawls 14*a* and 14*b*. Round $R_2$ is transferred into hoist tube 42 through shutters 44*a* and 44*b*. Further, FIG. 2 shows cam control cables 28*a* and 28*b*. Sensors/receivers 52*a* and 52*b* are placed as shown to detect the presence of a round in hoist tube 42. Loader structure 43 forms the outer boundary of loader drum 54 where rounds are stored to be transferred. Also rounds in hoist tube 42 may be removed via access door 56.

The disclosure herein above relates to some of the most important structural features and operational parameters for the high cycle rate transfer device. The operation of the device under a best mode scenario is described herein below.

Typically, the present invention is coupled to an ammunition magazine drum from where rounds of ammunition are to be hoisted to an upper gun chamber. Accordingly, the high cycle rate transfer device accepts the round at a lower level and raises it up to the gun chamber. Similarly, ammunition or any other material could be hoisted from a lower level to a desired higher level using the device disclosed herein.

Referring now to FIG. 1, pawl 14*a* is shown in the up position and pawl 14*b* is shown in an extended position. In a retracted position pawls 14*a* and 14*b* stow into track 16 (shown in phantom lines). As pawl 14*b* moves up raising round R, pawl 14*a* will be retracted and stored into track 16 as it moves down, (similar to that shown on the phantom line for pawl 14*b*). Retraction of either pawl 14*a* or 14*b* is accomplished in exactly the same manner. For example the retraction of pawl 14*a* is accomplished by preventing the left end support link 18*a* from moving using cam arm 22*a* as the pawl is lowered. When pawl 14*a* and support link 18*a* are fully retracted, the left end of support link 18*a* is able to move past cam arm 22*a* in its extended position. In its fully retracted position guide pin 40*a* on pawl 14*a* is constrained in track 16 to prevent it from extending into hoist tube 42 before it reaches the bottom.

When pawl 14*a* reaches the bottom, guide pin 40*a* comes to rest in a contoured surface on the top of pawl control arm 34*a*. Both pawl control arms, 34*a* and 34*b* are pivoted simultaneously moving pawl 14*a* into position to raise round R and the opposite control arm into position to receive guide pin 40*b* on pawl 14*b*. One complete hoist cycle is thus completed and the hoist is ready to begin raising another round R using pawl 14*a*.

The two cam arms 22*a* and 22*b*, which are primarily used to retract pawl linkage at the top of hoist tube 42, are connected to pawl control arms 34*a* and 34*b*, via push/pull cables 28*a* and 28*b*. Accordingly, only a single hydraulic linear actuator, pawl control actuator 30, is required to position all the mechanisms controlling the relative positions of pawls 14*a* and 14*b*. During a round transfer cycle described herein above, when pawl 14*a* is all the way down and pin 40*a* is seated in pawl control arm 34*a* at restrainer section 38. Hydraulic pressure is applied to the upper end of actuator 30, and a spool moves downward overcoming a spring energized spool locking detent. Complete spool movement is detected by switches which sense whether a switch actuator block, attached to the top of the valve spool, is in either extreme position. The actuator spool remains in the down position until pawl 14*a* begins to raise and switches over to its original position at the end of the cycle by extending pawl control arm 34*b*. Chain 10 is used to raise and lower pawls 14*a* and 14*b* and is driven by a single rotary actuator on the axis of chain drive sprocket 12.

During a typical raise stroke, pawl support link 18*a* or 18*b* (depending upon which pawl is being raised) rotates downward (clockwise on 18*a* if pawl 14*a* is being raised) until it stops against the edge surface of the pawl being raised. This forms a rigid structure with which to push round R.

When a lower positioned pawl is extended to its ready to raise position, at the bottom, pawl support link 18*a* or 18*b* is maintained at 80° angle with pawl 14*a* or 14*b*, respectively. This design feature enables connection link 36 and associated linkage to retract pawl 14*a* or 14*b* and allow rounds of ammunition to be lowered back down from the transfer station into the loader outer structure 43.

Referring now to FIG. 2, rounds of ammunition referred to as $R_1$, $R_2$, and $R_3$ are placed into loader drum 54 by another mechanism (not shown). To hoist a round R, a mechanism inside loader drum 54 pushes the round in the direction shown through shutters 44*a* and 44*b*, and into hoist tube 42. Shutters 44*a* and 44*b* are cammed open by the round in the direction shown by the arrows and are spring-returned to their original position once the round is fully into hoist tube 42. Pawls 14*a* and 14*b*, which raise the round in hoist tube 42, are positioned below in order to urge the round upwards inside hoist tube 42. In other words, pawls 14*a* or 14*b* is located immediately below the round to be hoisted such that when the pawls are moved the round is pushed upwards inside hoist tube 42. As pawls 14*a* or 14*b* are pushed by chain 10 they move through a slot in the floor between track 16 and come in contact with the round to be hoisted. In the interest of simplicity, pawls 14*a* and 14*b* are not shown in FIG. 2. Once the round is in hoist tube 42, the round must be either hoisted or removed via access door 56.

in FIG. 2, the centerline of chain 10 and track 16 is offset from the center of hoist tube 42. This is primarily to avoid contact of pawls 14*a* and 14*b* with the primer. The primer is what initiates detonation and is centrally located at the bottom of the round. Further, pawls 14*a* and 14*b* include non-metallic tips 41*a* and 41*b* (refer to FIG. 1) which cushion the contact between the round being hoisted and the pawl in contact therewith.

Accordingly, the high cycle rate transfer device disclosed herein does not require a retraction cycle which requires both energy and time. Instead, the present invention provides a high cycle rate by allowing two pawls to consecutively move material without the need for a retraction cycle. In essence, the present invention provides a continuous transfer of material with a single drive and actuator.

While a preferred embodiment of the high cycle rate transfer device has been shown and described, it will be appreciated that various changes and modifications may be made therein without departing from the spirit of the invention as defined by the scope of the appended claims.

What is claimed is:

1. A high cycle rate transfer device comprising:

a chain having a first and a second end disposed in a track;

means for driving said chain;

a first pawl with a first end, an intermediate section and a second end;

a second pawl with a first end, an intermediate section and a second end;

said first end of said first pawl connected to said first end of said chain;

said first end of said second pawl connected to said second end of said chain;

a first guide pin connected to said first pawl at said intermediate section;

a second guide pin connected to said intermediate section of said second pawl;

a first pawl support link connected to said intermediate section of said first pawl a second pawl support link connected to said intermediate section of said second pawl;

a first pawl cam arm connected to a first cam arm control cable;

a second pawl cam arm connected to a second cam arm control cable;

said first pawl cam arm located to guide said first pawl support link in said track wherein said chain is disposed:

said second pawl cam arm located to guide said second pawl support link in said track wherein said chain is disposed;

a first pawl control arm connected to a first lower control cable;

said first pawl control arm further connected to said chain and having an extended section disposed in another track adjacent to said track in which said chain is disposed;

said first pawl control arm further having connections with a second pawl control arm; and said pawl control arm overlapping said second pawl and connected to said chain at said second end and further connected to a second lower cam arm control cable.

2. The device according to claim 1 wherein said first and said second pawls include non-metallic cushion tips at said second end.

3. The device according to claim 1 wherein said first cam arm control cable and said first lower control cable are connected.

4. The device according to claim 1 wherein said second cam arm control cable and said second lower cam arm control cable are connected.

* * * * *